US006058750A

United States Patent [19]

Li

[11] Patent Number: 6,058,750

[45] Date of Patent: May 9, 2000

[54] LOCK STRUCTURE

[75] Inventor: Chi-yuan Li, Thaishan Village, Taiwan

[73] Assignee: Tung Chu International Inc., Taipei, Taiwan

[21] Appl. No.: 09/330,037

[22] Filed: Jun. 11, 1999

[51] Int. Cl.[7] ..... E05B 27/06

[52] U.S. Cl. ..... 70/358; 70/409; 70/419; 70/491; 70/493

[58] Field of Search ..... 70/358, 405–407, 70/409, 419, 491, 493, DIG. 37

[56] References Cited

U.S. PATENT DOCUMENTS

| | | | |
|---|---|---|---|
| 1,020,208 | 3/1912 | Laughlin | 70/409 |
| 1,243,936 | 10/1917 | Henckler | 70/491 X |
| 3,621,688 | 11/1971 | Asmar et al. | 70/358 X |
| 3,656,328 | 4/1972 | Hughes | 70/358 X |
| 3,729,964 | 5/1973 | Hsu | 70/358 X |
| 4,761,977 | 8/1988 | Weatherby | 70/493 |

FOREIGN PATENT DOCUMENTS

| | | | |
|---|---|---|---|
| 176577 | 7/1935 | Switzerland | 70/358 |

*Primary Examiner*—Lloyd A. Gall
*Attorney, Agent, or Firm*—Bacon & Thomas

[57] ABSTRACT

An improved lock structure, and especially a lock structure in which a stepped shaped wall of the key hole in the lock core can be cooperated with a key to allow the key to be drawn out regardless of its angular position. The lock core can also be rotated from an unlocking position to a locking position without the key; convenience thus is increased. Besides, a plurality of pusher pins are allocated in multiple directions to increase the difficulty of unlocking by a thief, this can thereby increase theft-proof effect.

5 Claims, 7 Drawing Sheets

LOCK STRUCTURE

BACKGROUND OF THE INVENTION

1. Field of the Invention

The present invention relates to an improved lock structure, and especially to a lock structure which is more convenient in use and more difficult to be unlawfully unlocked by a thief, thus theft-proof effect can be enhanced.

2. Description of the Prior Art

Locks used in the markets presently are provided with rectangular key holes, the walls of the key holes are straight surfaces. Therefore, a thief can easily make a judgement according to the arranged pusher pins in the key holes with the straight surfaces and unlock with a master key. In this way, locks are subjected to loss of their theft-proof effect.

Conventional locks in the markets can only permit a key to be drawn out of it by rotating of the key to a predetermined position no matter in locking or unlocking by means of the serrated shape on one edge of the key which mates with the pusher pins. When the key is rotated from the predetermined position, the pusher pins can not be retreated and block the key from drawing out, and inconvenience of use can be resulted.

SUMMARY OF THE INVENTION

In view of the above stated disadvantages, the inventor of the present invention actively studied to provide an improved, simple and special lock structure which has an outstanding theft-proof effect as well as convenience of use. With this, the disadvantages resided in the conventional locks can be gotten rid of.

Therefore, the primary object of the present invention is to provide an improved lock structure. Wherein, the stepped shaped wall of the key hole thereof in the lock core can be cooperated with a key to allow the key to rotate to any angular position and can be drawn out when it is at the position. The lock core can also be rotated to the locking position without the key; convenience thus is increased. Besides, the pusher pins are allocated in multiple directions; thus the difficulty of unlocking by a thief can be much increased, this can thereby increase theft-proof effect.

The present invention will be apparent in other objects and the detailed structure thereof after reading the detailed description of the preferred embodiments thereof in reference to the accompanying drawings.

DETAILED DESCRIPTION OF THE PREFERRED EMBODIMENT

Figure 1:
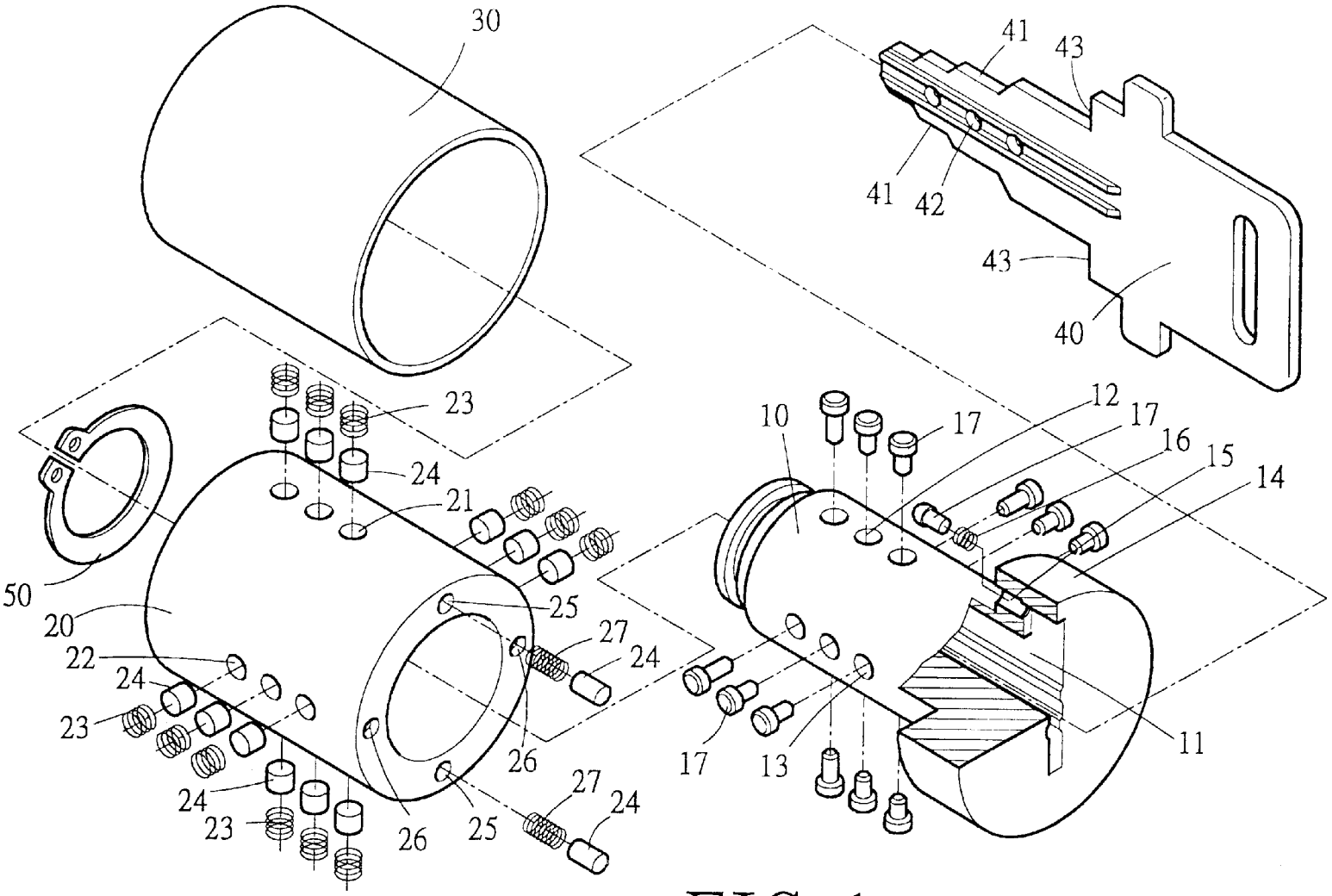
FIG. 1 is an analytical perspective view of the present invention.

Referring to FIG. 1, the improved lock structure of the present invention comprises a lock core 10, a sleeve 20 slipped over the lock core 10, a casing 30 slipped over the sleeve 20 and a key 40.

Wherein the lock core 10 has a key hole 11 which tapers from outside to inside of the lock core 10 to have a stepped form. The wall on the rear section of the lock core 10 is provided with a plurality of first pin holes 12 in a first direction and a plurality of third pin holes 13 in a third direction. The lock core 10 is provided on the front section thereof with a flange 14 of which the rear surface is provided with a plurality of second pin holes 15 in a second direction. The pin holes 12, 13 and 15 are all provided therein with pusher pins 17. The second pin holes 15 are provided additionally each with a first spring 16. The pusher pins 17 in the second pin holes 15 are pushed outwardly.

The sleeve 20 is a hollow cylinder, can be exactly fitted over the lock core 10. It is provided on the wall thereof with a plurality of first engaging holes 21 and a plurality of third engaging holes 22 corresponding respectively to the above mentioned first pin holes 12 and third pin holes 13. The first engaging holes 21 and the third engaging holes 22 are all provided therein with a plurality of third springs 23 and engaging pins 24. The front end face of the sleeve 20 is provided thereon with a plurality of second engaging holes 25 and positioning holes 26 corresponding respectively to the above mentioned second pin holes 15. The second engaging holes 25 are provided therein with a plurality of second springs 27 and engaging pins 24. The elastic modulus of the second springs 27 is larger than that of the first springs 16.

The shape of the key 40 corresponds to that of the key hole 11, and is provided with a first mating surface 41, a third mating surface 42 and a second mating surface 43 facing to the first pin holes 12, the third pin holes 13 and the second pin holes 15 respectively.

Figure 5:
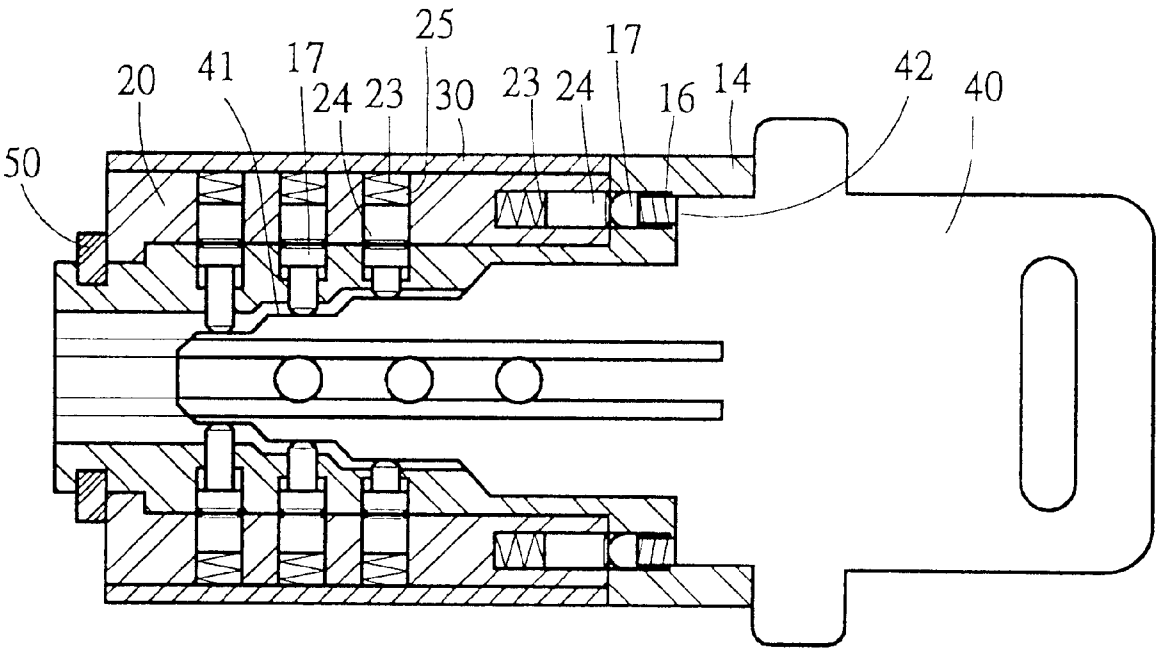
FIG. 5 is a sectional view showing the lock of FIG. 4 mating with a key.
Figure 6:
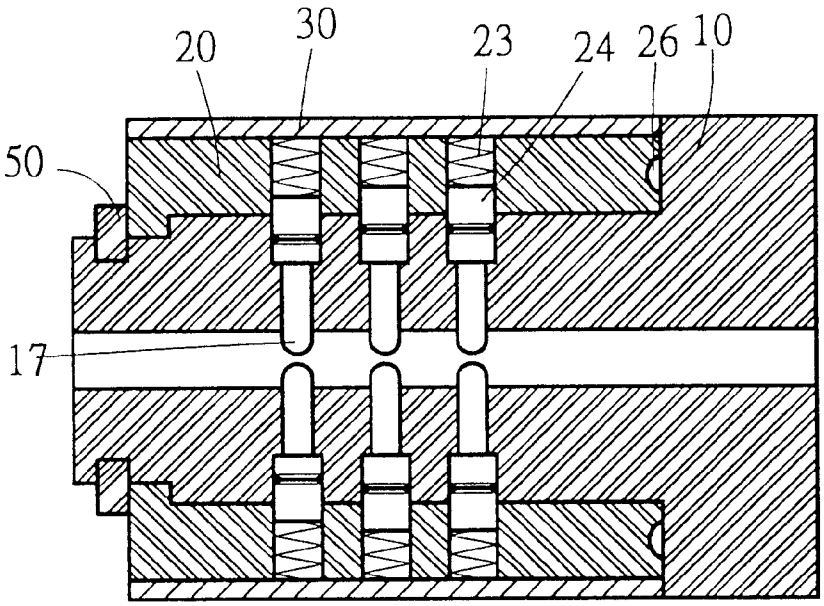
FIG. 6 is a sectional view taken from a section line 6—6 in FIG. 3.
Figure 7:
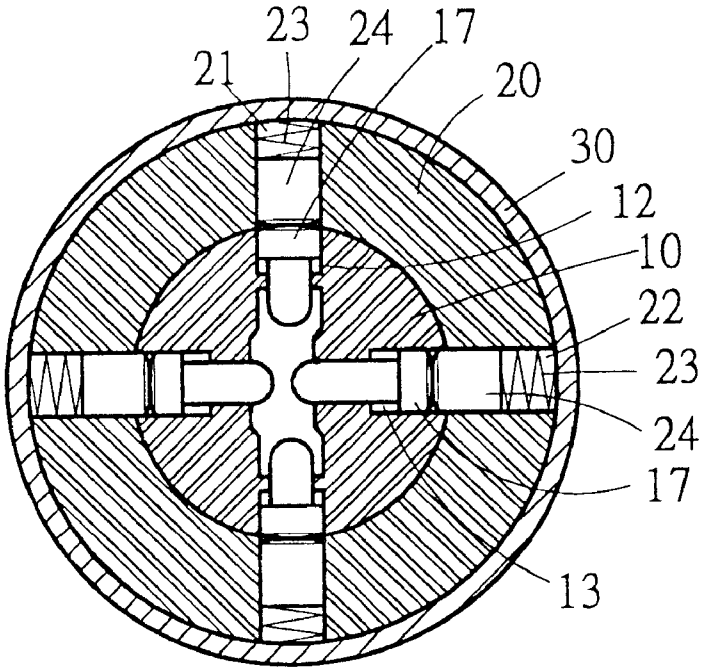
FIG. 7 is a sectional view taken from a section line 7—7 in FIG. 3.

As shown in FIG. 2, 3, 4, 6 and FIG. 7, when the lock core 10 is fitted in the sleeve 20, they can be limited from detaching with a C typed locking ring 50. And the casing 30 is fitted over the sleeve 20 to restrain the engaging pins 24 in the first engaging holes 21 and the third engaging holes 22. When the present invention is in the locking state, the first pin holes 12, the third pin holes 13 and the second pin holes 15 are respectively aligned with the first engaging holes 21, the third engaging holes 22 and the second engaging holes 25. The engaging pins 24 in the first engaging holes 21 are pushed by the third springs 23 to expose to the first pin holes 12, and engagement in the first and third directions can be established. The engaging pins 24 in the second engaging holes 25 are pushed by the second springs 27 to expose to the second pin holes 15, and engagement in the second direction can be established. Further as shown in FIG. 5, when the key 40 is inserted in the key hole 11, it pushes the pusher pins 17 and moves the inner ends of the engaging pins 24 to the positions where the first engaging holes 21 and the second engaging holes 25 are aligned with the pin holes 12 and 15. Then the key 40 can rotate the lock core 10 to the unlocking position; alternately, the lock core 10 can be rotated to the unlocking position without the help of the key 40.

The wall of the key hole 11 has a stepped form, thereby, a thief can not make sure of the relative reference positions of the pusher pins 17 when in unlawful unlocking, that is, difficulty of unlawful unlocking is increased. Synchronic engagement in multiple directions can not only enhance the strength of locking of the lock, but also further increase the difficulty of unlawful unlocking.

Again as shown in FIG. 5, by providing the stepped shape of the wall of the key hole 11, when the key 40 is inserted in the key hole 11, the key 40 can be taken out easily regardless of its angular position. With this feature, convenience of the lock is largely increased.

Figure 2:
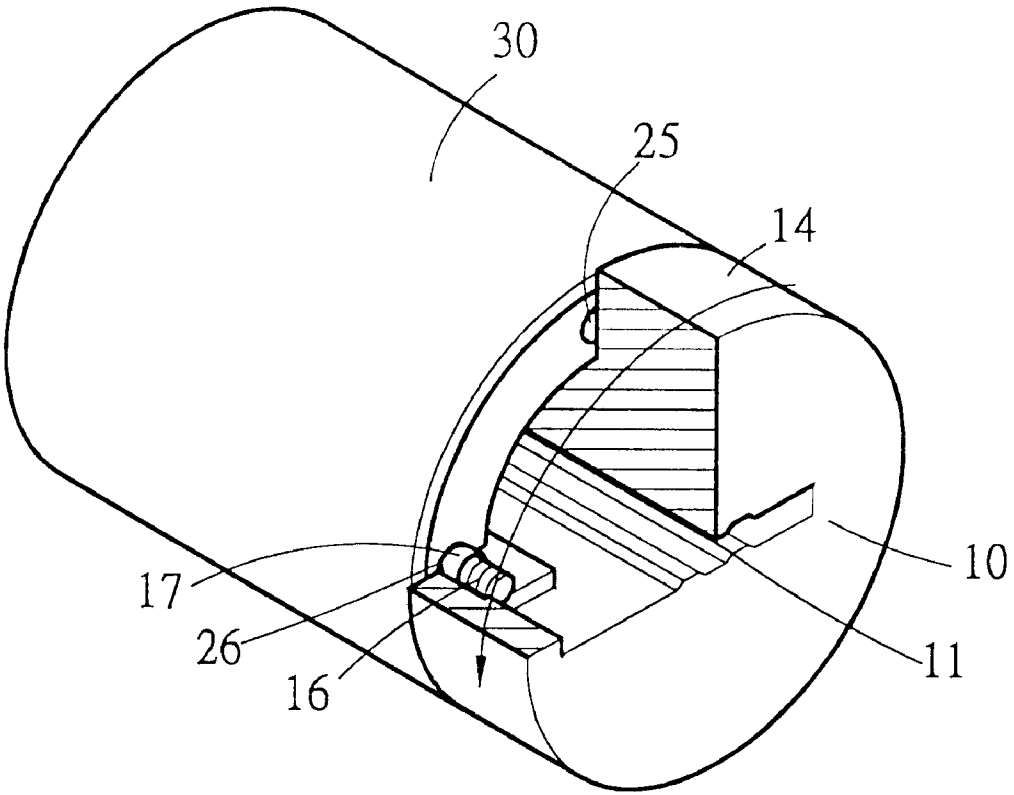
FIG. 2 is an exploded view showing positioning of the pusher pins in a second direction on the lock core and the sleeve of the lock of the present invention in an unlocking state.
Figure 3:
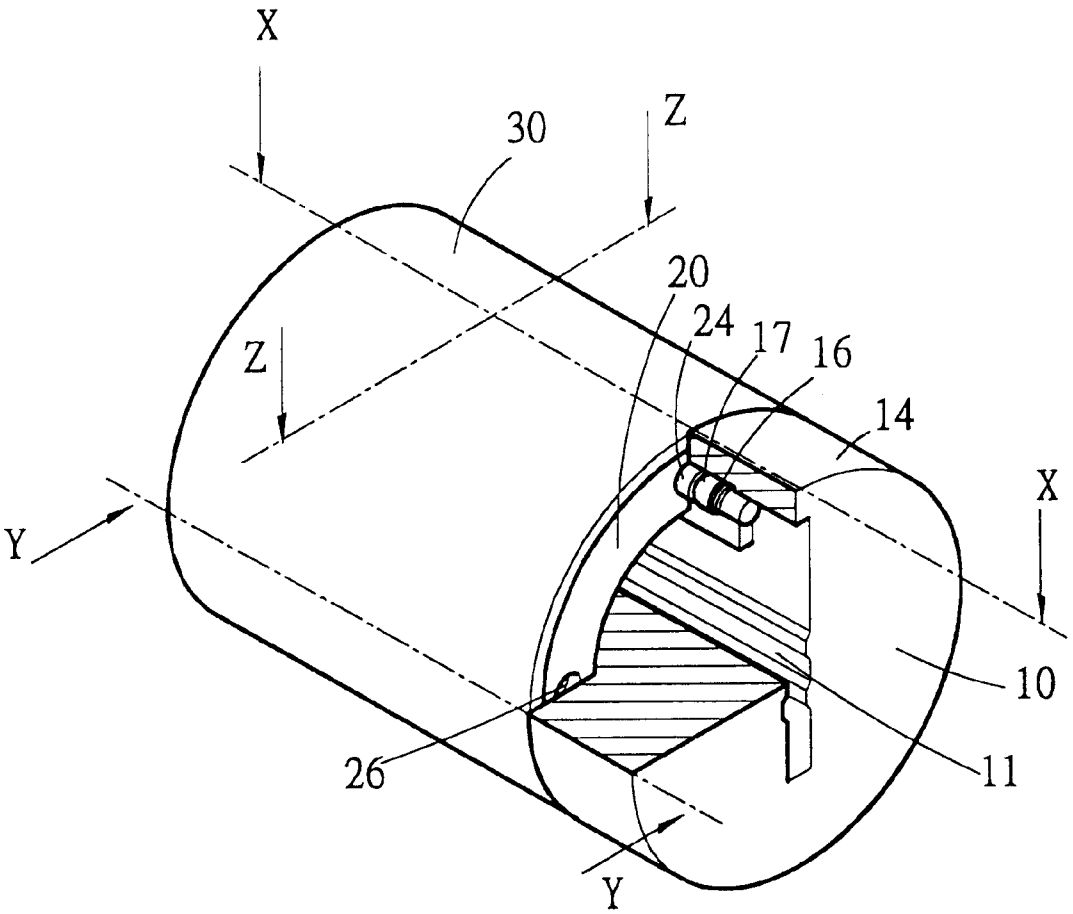
FIG. 3 is an exploded view showing the cooperation between the pusher pins and the engaging pins in the second direction on the lock core and the sleeve of the lock of the present invention in a locking state.
Figure 4:
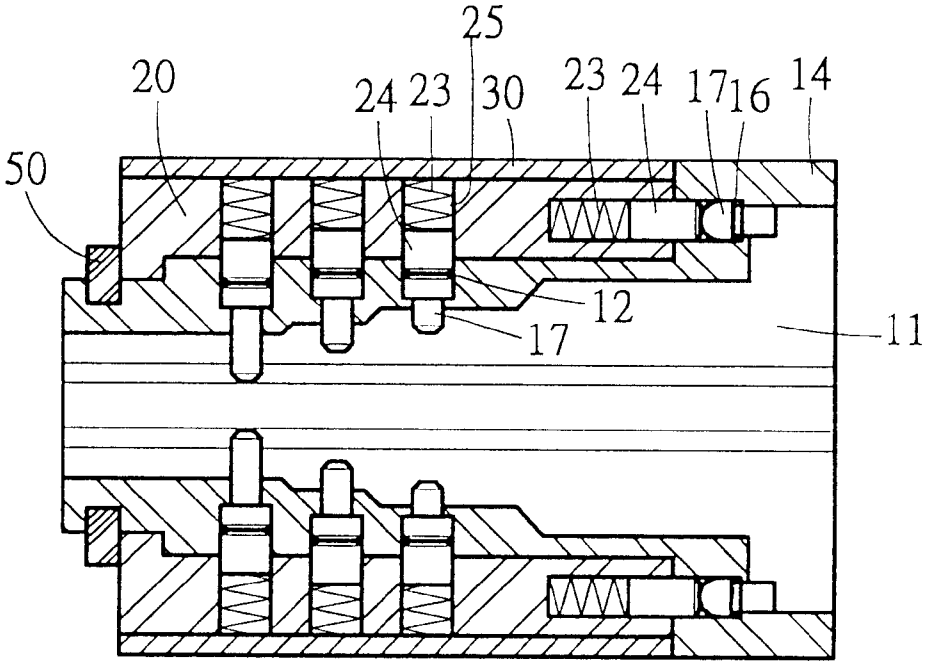
FIG. 4 is a sectional view taken from a section line 4—4 in FIG. 3.

As shown in FIG. 3, when the present invention is in the locking state, the engaging pins 24 in the second engaging holes 25 are exactly moved into the second pin holes 15, and engagement in the second direction is established. Further as shown in FIG. 2, after the lock core 10 is rotated to an unlocking position, the pusher pins 17 in the second pin holes 15 are pushed by the first springs 16 and are engaged into the positioning holes 26 to position the lock core 10 at the unlocking position. When the lock core 10 is rotated with a force, the pusher pins 17 will get out of the positioning holes 26. With this feature, a user can easily be sure that the lock core 10 is in the unlocking position. And the lock core 10 can be fixed at the unlocking position temporarily to prevent it from moving to its locking position inadvertently.

In assembling of the present invention, using the C typed locking ring 50, assembling of the lock core 10 and the sleeve 20 can be faster and more convenient.

In the structure of the improved lock structure of the present invention, synchronic engagement in multiple directions between the lock core 10 and the sleeve 20 can not only enhance the effect of theft-proofing, but also further increase convenience of use and efficiency of assembling.

Having now particularly described and ascertained the technical structure of my invention with practicability and improvement of my said invention and in what manner the same is to be performed, what I claim will be declared in the claims followed.

I claim:

1. An improved lock structure including a lock core, a sleeve slipping over said lock core, a casing slipping over said sleeve and a key, said lock is characterized by:

said lock core has a key hole of which the wall is tapered from outside to inside of said lock core to have a stepped shape, when said key is inserted in said key hole, said key can be taken out regardless of its angular position; and after the key is taken out, said lock core can be rotated from an unlocking position to a locking position without the help of said key; and lock core including a flange outside of said sleeve having pusher pins arranged substantially parallel to the direction of the key hole.

2. An improved lock structure as claimed in claim 1, wherein, a wall on the rear section of said lock core is provided with a plurality of first pin holes in a first direction, said first pin holes are provided therein with pusher pins;

said lock core is provided on the front section thereof with said flange of which the rear surface is provided with a plurality of second pin holes in a second direction, said second pin holes are also provided therein with said pusher pins and are provided additionally each with a first spring;

said sleeve is a hollow cylinder being exactly fitted over said lock core, and is provided on the wall thereof with a plurality of first engaging holes corresponding to said first pin holes, said first engaging holes are all provided therein with a plurality of third springs and engaging pins, the front end face of said sleeve is provided thereon with a plurality of second engaging holes corresponding to said second pin holes, said second engaging holes are provided therein with a plurality of second springs and engaging pins, the elastic modulus of said second springs is larger than that of said first springs;

the shape of said key corresponds to that of said key hole, and is provided with a first mating surface, a third mating surface and a second mating surface facing to said first pin holes, to third pin holes and to said second pin holes respectively;

after assembling said improved lock structure, synchronic engagement in multiple directions between said lock core and said sleeve by means of said engaging pins locks said lock core and said sleeve together, while said key can be taken out regardless of its angular position, and said lock core can be rotated from its unlocking position to its locking position without the help of said key.

3. An improved lock structure as claimed in claim 2, wherein, said lock core is provided on the wall thereof with a plurality of said third pin holes in a third direction, said third pin holes are provided therein with pusher pins;

said sleeve is further provided on the wall thereof with a plurality of third engaging holes corresponding to said third pin holes, said third engaging holes are provided therein with a plurality of third springs and engaging pins.

4. An improved lock structure as claimed in claim 2, wherein, the front end face of said sleeve is provided thereon with a plurality of positioning holes corresponding respectively to said second pin holes when said lock core is in its unlocking position, so that when in unlocking position, said first springs move said pusher pins into said positioning holes, and said lock core is positioned in its unlocking position.

5. An improved lock structure as claimed in claim 2, wherein, a "C" typed locking ring is used in assembling of said lock core and said sleeve.

* * * * *